US011958105B2

(12) United States Patent
Gerding

(10) Patent No.: US 11,958,105 B2
(45) Date of Patent: Apr. 16, 2024

(54) RAPID SOLIDIFICATION OF MOLDED PRODUCTS

(71) Applicant: Honda Motor Co., Ltd., Tokyo (JP)

(72) Inventor: Benjamin Jacob Gerding, Ottawa, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 157 days.

(21) Appl. No.: 17/690,554

(22) Filed: Mar. 9, 2022

(65) Prior Publication Data

US 2023/0286041 A1 Sep. 14, 2023

(51) Int. Cl.
*B22C 9/02* (2006.01)
*B22D 27/04* (2006.01)

(52) U.S. Cl.
CPC ..... *B22D 27/045* (2013.01); *B22C 9/02* (2013.01)

(58) Field of Classification Search
CPC ..... B22C 9/02; B22D 27/04; B22D 27/045
See application file for complete search history.

(56) References Cited

U.S. PATENT DOCUMENTS 4,162,700 A * 7/1979 Kahn ..... B22D 27/04 164/126
5,735,334 A 4/1998 Sutton et al.
6,088,934 A 7/2000 Newton
7,290,583 B2 11/2007 Crafton et al.
8,622,113 B1 * 1/2014 Rau, III ..... B22D 27/045 164/348
9,592,550 B2 3/2017 Kawabata et al.
10,000,835 B2 6/2018 Kubota et al.
2015/0083280 A1 3/2015 Grassi et al.
2018/0178273 A1 6/2018 Pellizzon
2018/0369906 A1 12/2018 Di Serio et al.
2022/0048104 A1 * 2/2022 Han ..... B22C 9/061

FOREIGN PATENT DOCUMENTS

JP 2005349468 12/2005
WO 2013085401 6/2013
WO 2018191111 10/2018

* cited by examiner

*Primary Examiner* — Kevin E Yoon
(74) *Attorney, Agent, or Firm* — RANKIN, HILL & CLARK LLP

(57) ABSTRACT

A molding system includes a mold and a fluid delivery system. The mold includes a fluid permeable material that defines a mold cavity and is permeable to a cooling fluid. The mold is configured to mold a molten material arranged in the mold cavity. The fluid delivery system is in fluid communication with the fluid permeable material, and is configured to deliver the cooling fluid via nozzles to the fluid permeable material. When the molten material is arranged in the mold cavity, the fluid delivery system delivers the cooling fluid to the fluid permeable material at a delivery pressure that is intentionally varied, such that the cooling fluid permeates through the fluid permeable material to cool and solidify the molten material arranged in the mold cavity to form a solidified outer skin. The delivery pressure may be varied, e.g. increased, as a thickness of the solidified outer skin increases.

19 Claims, 6 Drawing Sheets

RAPID SOLIDIFICATION OF MOLDED PRODUCTS

BACKGROUND

Sand molds are used to form molten material into a cooled solid object. Sand molds are relatively easy and inexpensive to make, and thus are desired for the mass production of metal parts. However, one limiting factor in the mass production of parts is the cooling rate of the molten material inside the sand mold, which determines how long it takes to make each part, and thus limits the number of parts that can be produced in a given time period using one mold.

BRIEF DESCRIPTION

According to one aspect, a method of solidifying a molten material includes providing the molten material in a cavity defined by a mold, the mold comprising a fluid permeable material; and delivering a fluid to the fluid permeable material such that the fluid permeates through the fluid permeable material and solidifies the molten material to a) form a solidified outer skin at a surface of the molten material, b) increase a thickness of the solidified outer skin, or c) both a) and b). The fluid is delivered to the mold at a delivery pressure that is intentionally varied.

According to another aspect, a method of solidifying a molten material includes providing a mold including a fluid permeable material, and providing nozzles arranged in voids in the fluid permeable material; arranging a molten material in a cavity defined by the mold; and delivering a cooling fluid to the fluid permeable material via the nozzles such that the cooling fluid permeates through the fluid permeable material, cools the molten material, and solidifies the molten material to form a solidified outer skin. The cooling fluid is delivered successively through the nozzles such that the molten material is directionally solidified in a desired direction through the cavity. The cooling fluid is delivered to the mold at a delivery pressure that is intentionally varied.

According to another aspect, a molding system includes a mold including a fluid permeable material that defines a mold cavity and is permeable to a cooling fluid, the mold being configured to mold a molten material arranged in the mold cavity; and a fluid delivery system in fluid communication with the fluid permeable material, and configured to deliver the cooling fluid to the fluid permeable material. When the molten material is arranged in the mold cavity, the fluid delivery system delivers the cooling fluid to the fluid permeable material at a delivery pressure that is intentionally varied, such that the cooling fluid permeates through the fluid permeable material to cool and solidify the molten material arranged in the mold cavity to form a solidified outer skin.

DETAILED DESCRIPTION

Figure 1:
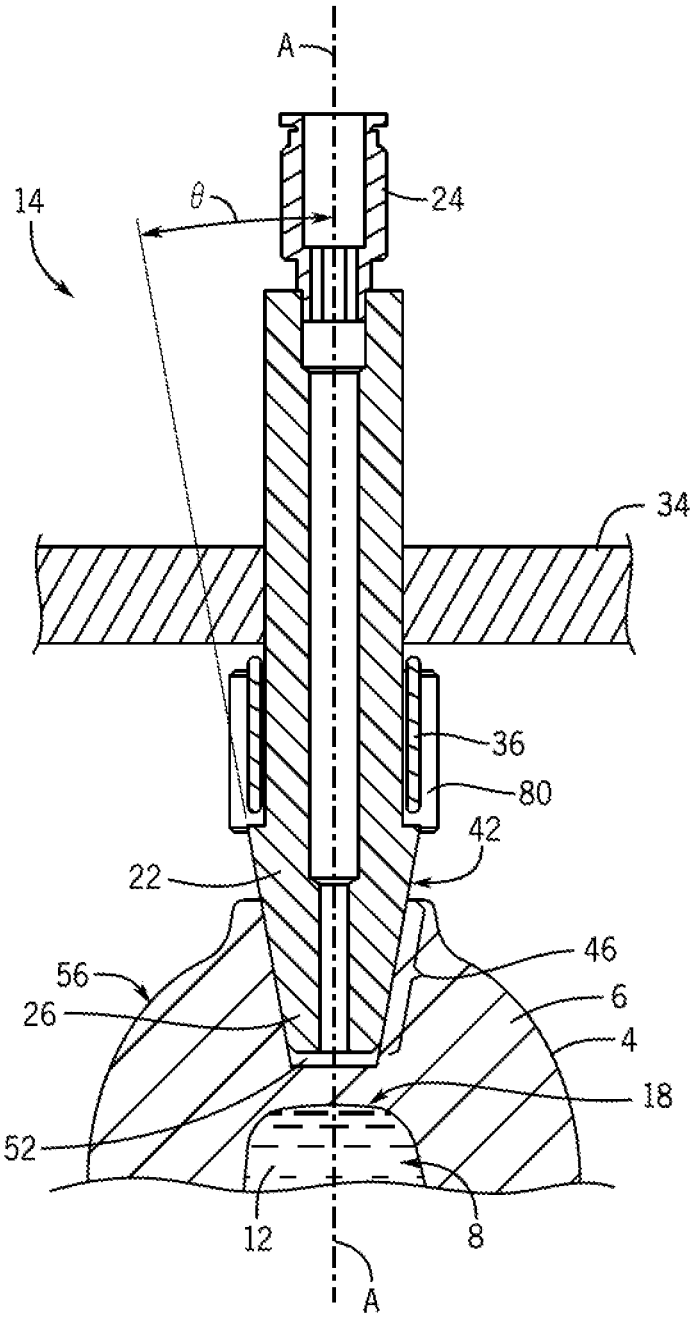
FIG. 1 is a cross section view of portion of a fluid delivery system and a mold containing molten material according to the present subject matter.
Figure 2:
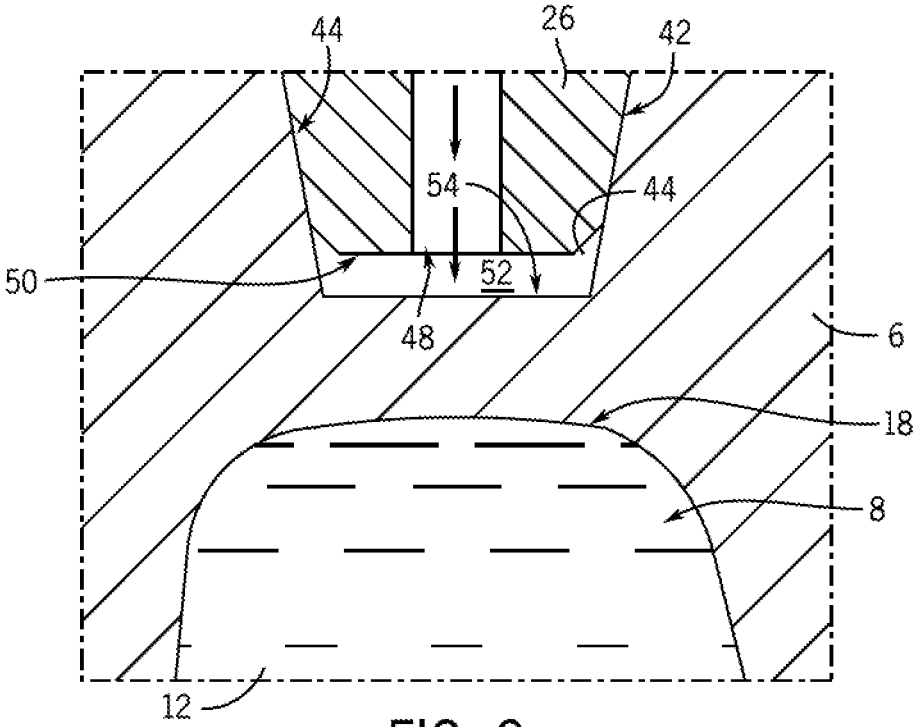
FIG. 2 is a cross section view of a portion of a tip of a nozzle arranged in a void in a mold containing molten material according to the present subject matter.

Referring now to the accompanying figures, a molding system 2 includes a mold 4 made of a fluid permeable material 6. The fluid permeable material 6 is permeable to a fluid 10 (also referred to herein as a "cooling fluid"), and is shaped so as to define a mold cavity 8 (also referred to herein as "cavity"). The mold 4 is configured to mold a molten material 12 arranged in the mold cavity 8, such that the molten material 12 cools while in the mold 4 to become a solid material in the shape of the mold cavity 8.

The system 2 includes a fluid delivery system 14 in fluid communication with the fluid permeable material 6. The fluid delivery system 14 is configured to deliver the fluid 10 to the fluid permeable material 6 at a delivery pressure that is intentionally varied. The fluid permeable material 6 is permeable to the fluid 10, and is configured to allow the fluid 10 to permeate through the fluid permeable material 6, optionally contact the molten material 12, and thus result in the solidification of the molten material 12 arranged in the mold cavity 8, and thereby initially forming a solidified outer skin 16 at a surface 18 of the molten material 12, and then to further solidify the molten material 12 in the mold cavity 8 so that eventually all of the molten material 12 becomes a solid material in the shape of the mold cavity 8.

System

The system 2 can be used to make a molded object having a shape, size, and dimensions associated with the shape, size, and dimensions of the mold cavity 8, and this is accomplished by solidifying the molten material 12 arranged in the mold cavity 8. The system 2 includes the mold 4 and the fluid delivery system 14.

Mold

The mold 4 is used for producing a molded object, where the molten material 12 is delivered to the mold cavity 8, the molten material 12 is contained in the mold cavity 8, and the molten material 12 cooling and solidifying into a solid material in the mold cavity 8, thus forming a molded object, which may be subsequently released from the mold 4. The mold 4 defines the mold cavity 8, which may have any size, shape, and dimensions as desired for creating a desired molded object.

The mold 4 includes the fluid permeable material 6. The fluid permeable material 6 may be formed to create the mold 4 and thus define the mold cavity 8. The fluid permeable material 6 may form the inside surface of the mold 4 that defines the mold cavity 8.

The fluid permeable material 6 is not particularly limited, so long as it is permeable to the cooling fluid 10 (e.g. porous), where the cooling fluid 10 may include water, air, liquid nitrogen, other fluid material that can permeate through the fluid permeable material 6 to help cool and thus solidify the molten material 12, or combinations thereof.

The fluid permeable material 6 is not particularly limited, and may include a porous material such as sand. The mold 4 may be a sand mold made of the fluid permeable material 6, where the fluid permeable material 6 includes sand, a binder for keeping the sand in a desired shape, and optional additives including water, clay, and/or carbonaceous material, for example. The binder may provide strength to the fluid permeable material 6 so that it can be formed to make the mold 4, and so that it can keep its shape both before and after delivery of the cooling fluid 10 to the mold 4. The fluid permeable material 6 may be formed by any method, including molding, three-dimensional printing, or other methods of shaping the fluid permeable material 6 to form the mold 4. The binder in the fluid permeable material 6 may include clay, water, a resin, or other material. If a resin is used, the resin may be cured after the fluid permeable material 6 is shaped as desired to strengthen the mold 4. The mold 4 may be a single-use mold, or multiple-use mold. The fluid permeable material 6 may be hydrophobic (e.g. oil based), which characteristic may be the result of the binder being hydrophobic; or hydrophilic, wherein the binder may be wetted by water. The binder may include, but is not limited to include, furane binders, phenolic binders, phenolic urethane binders, phenolic ester binders, inorganic binders such as sodium silicate, oil cores, acrylic-epoxy, green sand, or combinations thereof.

The fluid permeable material 6 may include other fluid permeable material 6, such as aggregates or man-made materials, so long as the fluid permeable material 6 allows for the permeation of the cooling fluid 10 through its bulk.

Fluid Delivery System

The fluid delivery system 14 is configured to deliver the cooling fluid 10 to the fluid permeable material 6 of the mold 4 so that the cooling fluid 10 can permeate through the fluid permeable material 6 and thus solidify the molten material 12 in the mold cavity 8. The fluid 10 may help solidify the molten material 12 by permeating through the fluid permeable material 6 and removing heat from the molten material 12. The cooling fluid 10 may draw heat directly out of the molten material 12 by permeating through the fluid permeable material 6 and directly contacting the molten material 12 in the mold cavity 8; and/or the cooling fluid 10 may draw heat indirectly out of the molten material 12 by the cooling fluid 10 not directly contacting the molten material 12, but instead permeating through the fluid permeable material 6 and thus drawing heat directly out of the fluid permeable material 6, while the fluid permeable material 6 contact the molten material 12 and thus draws heat directly out of the molten material 12.

The cooling fluid 10 may include various liquids and non-liquids combinations thereof, including water, air, liquid nitrogen, surfactant (e.g. soap), other fluids that can permeate through the fluid permeable material 6 to help cool and thus solidify the molten material 12, or combinations thereof. The surfactant may be included with water as the cooling fluid 10 when the fluid permeable material 6 is hydrophobic. The inclusion of the surfactant may change the sorptivity of the hydrophobic fluid permeable material 6 to the water, thus allowing the water-based cooling fluid 10 to more easily flow through the hydrophobic fluid permeable material 6.

The fluid delivery system 14 may include a fluid supply 20 from which the cooling fluid 10 is supplied to the mold 4, which fluid supply 20 may include a fluid reservoir, which may be pressurized, for holding the cooling fluid 10 and/or a pump for urging the cooling fluid to the mold 4; one or more nozzles 22 for ejecting the fluid 10 into the fluid permeable material 6; fluid conduits 24 (also referred to herein as "tubes") for fluidly connecting the fluid supply 20 to the nozzles 22 and delivering the cooling fluid 10 from the fluid supply 20 to the nozzles 22; a sensor 28 for monitoring a delivery pressure of the fluid 10 (e.g. inside the tubes 24); a valve 30 for regulating the flow of the fluid 10 through tubes 24 and to the nozzles 22; a cooling plate 32; a frame 34 for mounting the nozzles 22 relative to the mold 4; resilient members 36 (e.g. a spring) mounted on the frame 34 and used for urging the nozzles 22 toward the mold 4; a controller 38 for controlling the sensor 28, the valve 30, and the pump; or combinations thereof.

Figure 3:
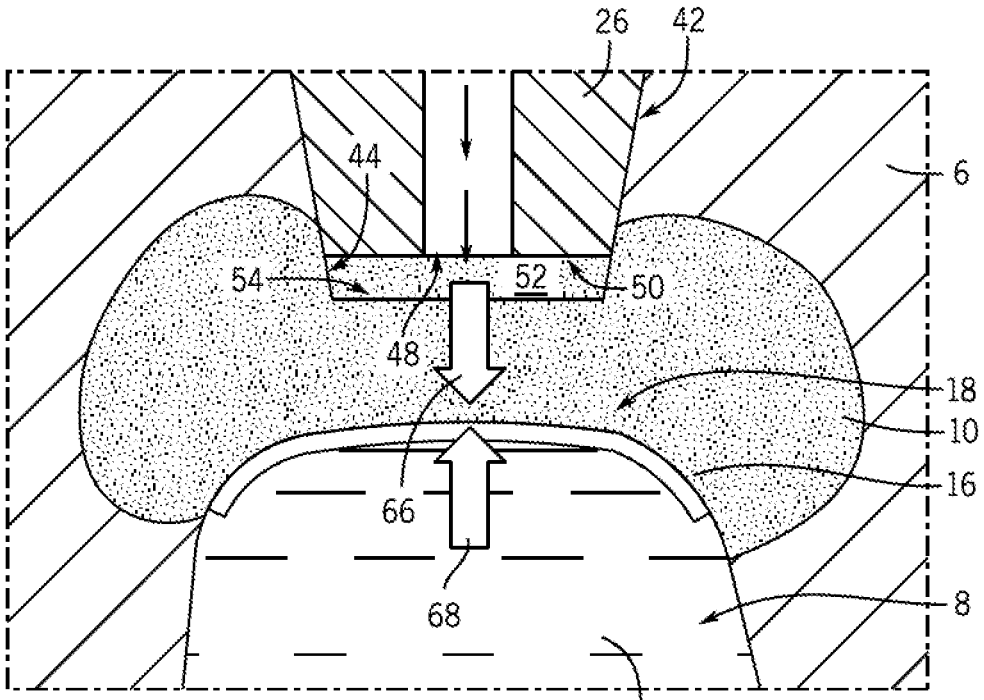
FIG. 3 is a cross section view of a portion of a tip of a nozzle arranged in a void in a mold and delivering a cooling fluid to cool molten material contained in the mold according to the present subject matter.

The fluid delivery system 14 operates to deliver the fluid 10 to the fluid permeable material 6 at a delivery pressure that is intentionally varied. The delivery pressure may be a pressure of the fluid 10 that is being delivered by the fluid delivery system 14 as measured by the sensor 28. The delivery pressure may be varied by controlling operation of the valve 30, controlling operation of the pump (if included), changing a height of the fluid reservoir relative to the nozzles 22, pressurizing the fluid reservoir, changing a flow rate the cooling fluid 10 through the fluid delivery system 14, other known means of controlling the delivery pressure, or combinations thereof. Any of these controls may be used alone or in combination in order to adjust the delivery pressure as measured by the sensor 28. In one aspect, only the flow rate of the cooling fluid 10 is adjusted, and this may be monitored directly by using a flow sensor as the sensor 28. Increasing the flow rate of the cooling fluid 10 through the fluid delivery system 14 may result in an increase in the delivery pressure of the cooling fluid 10 in the fluid delivery system 14, and may increase the dynamic pressure 66 (FIG. 3) that is exerted by the cooling fluid 10 against the molten material 12 and any solidified outer skin 16.

The fluid supply 20 may include only the fluid reservoir without the pump. In this case, the cooling fluid 10 may be delivered to the mold 4 by the operation of gravity. The system 14 may include a fluid collector and/or a fluid recycler, which may collect any cooling fluid 10 that escapes from the mold 4 and deliver the collected cooling fluid 10 back to the fluid reservoir. The fluid supply 20 may include only the pump, which may urge the cooling fluid from a separate and distinct fluid supply to the mold 4. The fluid supply 20 may include both the fluid reservoir and the pump, in which case the pump may operate to urge the cooling fluid 10 from the fluid reservoir to the mold 4.

Each nozzle 22, is a device designed to control the direction or characteristics of the flow of the cooling fluid 10 as the cooling fluid 10 exits the fluid path of the fluid delivery system 14. Each nozzle 22, at least the distal end 26 (also referred to herein as tip 26) of each nozzle 22 for example, may be connected to the mold 4 by being arranged in a void in the mold 4 and held therein by a frame 34 and resilient member 36. The void may be defined by a side wall 44 and an optional bottom wall 54 (FIGS. 1-3 and 7 include a side wall 44 and a bottom wall 54, FIGS. 4-5 only have a side wall 44). The void may be pre-formed in the mold 4, such as by machining or molding the fluid permeable material 6 to form the void, and the nozzle 22 may be arranged in the void thereafter. In FIGS. 1-4, 6, and 7, the nozzle 22 is inserted into the void from an outside of the mold 4. In FIG. 5, the nozzle 22 is inserted into the void from an inside of the mold 4, i.e. from the mold cavity 8 and secured to the mold 4 by a nut 40, which can be tightened down onto the nozzle 22 and thus press against the mold to keep the nozzle 22 firmly inside the void in the mold 4.

The nozzle 22 and the void may have corresponding configurations so that they contact each other over a mutual contact area 46, thus forming a seal over this contact area 46 at an interface between the nozzle 22 and the void. The seal formed by mating the nozzle 22 with the void may be fluid-tight to an extent that the seal inhibits the cooling fluid 10 from leaking out of the mold 4 past such seal.

The nozzle 22 may mate with the void by the nozzle 22 having a projecting shape that fits inside the indented shape of the void and mates with the indented shape at an interface. The nozzle 22 and the void thus may have a male (i.e. nozzle 22) to female (i.e. void) coupling between them at the interface. The nozzle 22 and void may each have a circular-shaped cross section when taken perpendicular to a longitudinal axis A of the nozzle 22 so that they may easily mate with each at the interface other no matter the rotational orientation of the nozzle 22 with respect to the void.

The seal between the nozzle 22 and the void may be formed at the interface by a close fitting between a side wall 42 of the nozzle 22 and the side wall 44 of the void. For example, the side walls 42, 44 may be angled the same amount with respect to longitudinal axis A of the nozzle 22 when mated. The angle of the side walls 42, 44 is referred to herein as the draft angle Θ, which may range from 1°-45° from the longitudinal axis A. The contact area 46 defined by the interface between the side walls 42, 44 may thus be frustoconical. The contact area 46 between the nozzle 22 and the void may be larger than the largest cross-sectional area of the void taken perpendicular to the longitudinal axis A.

Figure 6:
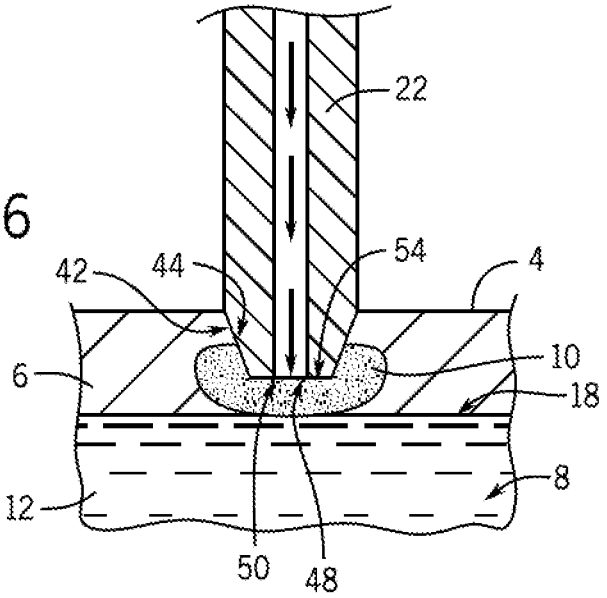
FIG. 6 is a cross section view of a portion of a tip of another nozzle arranged in a void in a mold and delivering a cooling fluid to cool molten material contained in the mold according to the present subject matter.

Each nozzle 22 includes one or more exit openings 48 through which the cooling fluid 10 exits the fluid delivery system 14 and enters the fluid permeable material 6. In FIGS. 1-3 and 6-8, each nozzle 22 includes one exit opening 48 on a distal-facing surface 50 of the nozzle 22 (i.e. bottom surface in the drawings which may be the most-distal surface of the nozzle 22), which exit openings 48 may face the bottom wall 54 of the void. This exit opening 48 directs the cooling fluid 10 in a distal direction as it exits the nozzle 22 (i.e. downward direction in the drawings) and toward the molten material 12, as shown by the arrows. In FIGS. 1-3 and 7, the cooling fluid 10 then enters a gap 52 between the distal-facing surface 50 of the nozzle 22 and the bottom wall 54 of the void. In these figures, the gap 52 is within the fluid permeable material 6. From the gap 52, the cooling fluid 10 permeates in various directions through the fluid permeable material 6 of the mold 4 as shown between FIGS. 2 and 3 and toward the molten material 12. In FIG. 6, the cooling fluid 10 enters directly into the fluid permeable material 6 without entering a gap 52, and permeates in various directions through the fluid permeable material 6 and toward the molten material 12.

Figure 7:
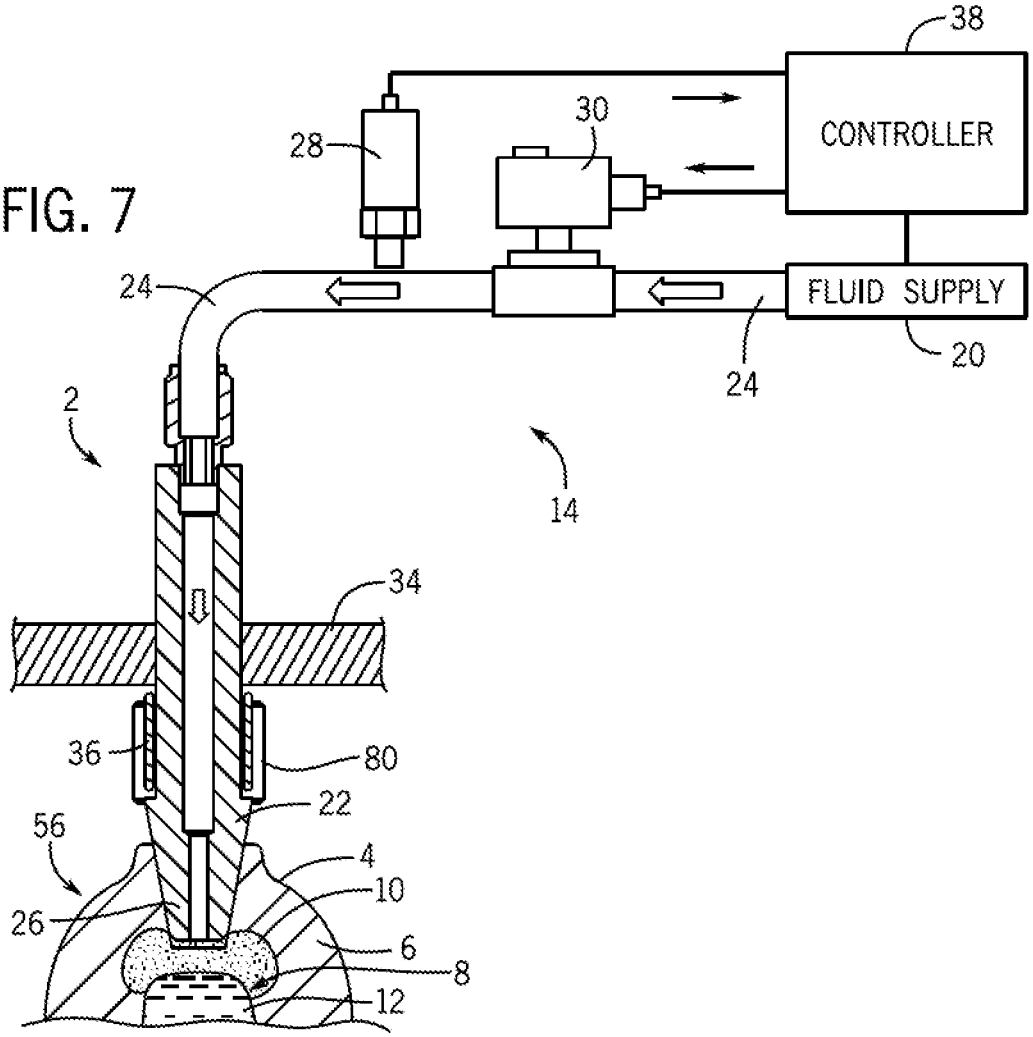
FIG. 7 is a cross section view of a system for delivering a cooling fluid to a mold containing a molten material according to the present subject matter.
Figures 8A, 8B, 8C, 8D:
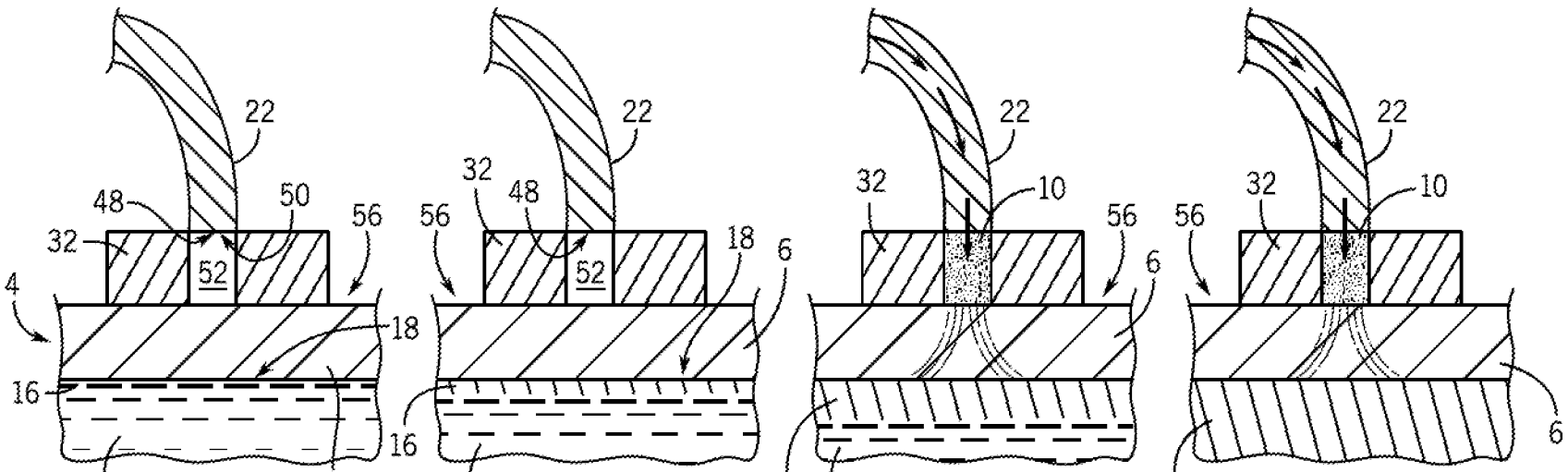
FIGS. 8A-8D are cross section views showing steps of a process where molten material is being cooled in a mold according to the present subject matter.

In FIGS. 1-7, the nozzle 22 sits inside the void. In FIGS. 8A-8D, the nozzle 22 is connected to a cooling plate 32 that contacts the outer surface 56 of the mold 4, which does not have a void in which the nozzle 22 is arranged. Instead, the cooling plate 32 may be held against the outer surface 56 by the resilient member 36 and frame 34 (not shown in FIGS. 8A-8D) in a similar way as shown in FIG. 1. As the cooling fluid 10 exits the exit opening 48, the cooling fluid 10 is directed distally (i.e. downward in the drawings) and enters the gap 52 defined by the cooling plate 32 between the exit opening 48 and the fluid permeable material 6. In this figure, the gap 52 is extrinsic (i.e. outside) from the fluid permeable material 6. From the gap 52, the cooling fluid permeates in various directions through the fluid permeable material 6 toward the molten material 12. The molten material 12 is first introduced into the mold 4 as shown in FIG. 8A, and begins to solidify even if no cooling fluid 10 is introduced through the nozzle 22. The molten material 12 starts to form a solidified outer skin 16 at the interface with the fluid permeable material 6 due to the fluid permeable material 6 drawing heat out of the molten material 12. Once the skin 16 has a particular thickness and thus a particular strength, the cooling fluid 10 may be delivered via the nozzle 22 (FIG. 8B) and introduced into the fluid permeable material 6, where it enters the gap 52, and thus permeates in different directions toward the molten material 12. This introduction of the cooling fluid 10 into the fluid permeable material 6 increases the rate at which heat is drawn out of the molten material 12, and thus further cools and solidifies the molten material 12 and increase the thickness of the skin 16 (FIG. 8D), and such cooling and solidifying is accomplished faster than if no cooling fluid 10 were permeated through the fluid permeable material 6. The cooling plate 32 may be formed from a heat conductive material, such as metal, that draws heat from the fluid permeable material 6, and is cooled by the cooling fluid 10, and thus may further contribute to the cooling and solidifying of the molten material 12.

Figure 4:
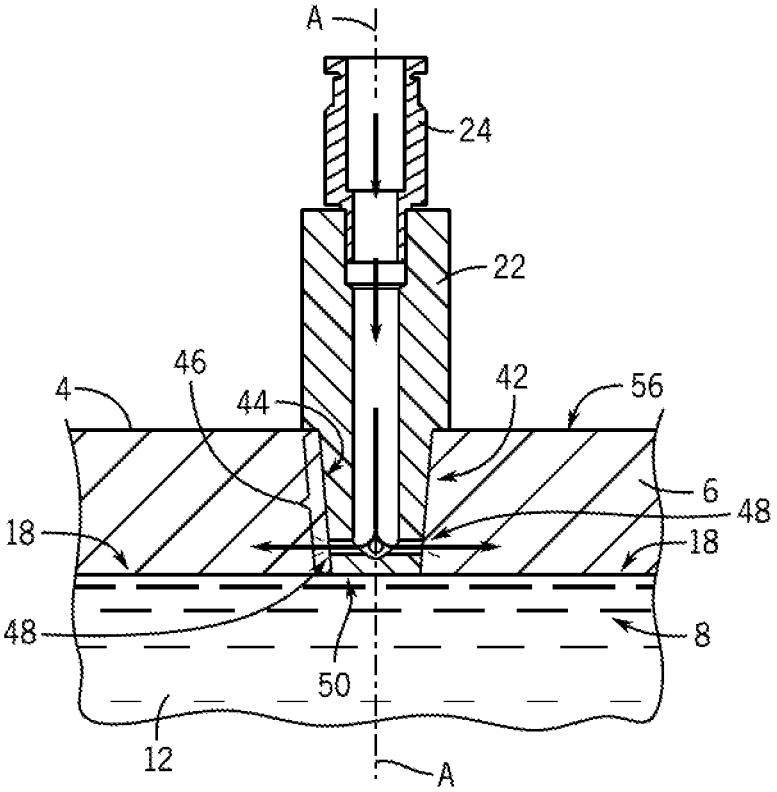
FIG. 4 is a cross section view of a portion of a tip of another nozzle arranged in a void in a mold and delivering a cooling fluid to cool molten material contained in the mold according to the present subject matter.
Figure 5:
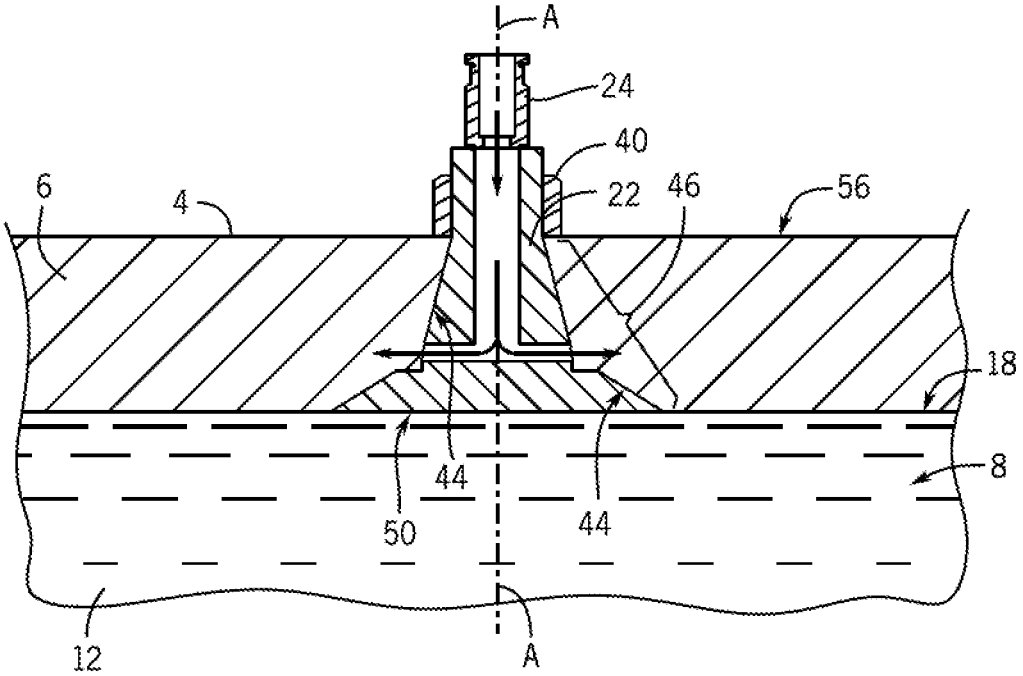
FIG. 5 is a cross section view of a portion of a tip of another nozzle arranged in a void in a mold and delivering a cooling fluid to cool molten material contained in the mold according to the present subject matter.

In FIGS. 4-5, each nozzle 22 is shown to have two exit openings 48 (however, there can be more exit openings 48) arranged in the side wall 42 of the nozzle 22. These exit openings 48 direct the cooling fluid 10 in a lateral direction, e.g. perpendicular to the longitudinal axis A (i.e. left and right directions in the drawings) as shown by the arrows, into the fluid permeable material 6 and then it permeates in different direction through the fluid permeable material 6. The cooling fluid 10, because it is directly laterally, may or may not come into direct contact with the molten material 12 or the outer skin 16. The void in each of FIGS. 4-5 is a through hole extending all the way through the mold 4, such that the distal-facing surface 50 of the nozzle 22 defines a portion of the mold cavity 8 and comes into direct contact with the molten material 12. In this way, the distal-facing surface 50 acts as a cooling surface to directly cool the molten material 12 upon direct contact with the molten material 12.

The conduits 24 fluidly connect the nozzles with the fluid supply 20, and deliver the cooling fluid 10 from the fluid supply 20 to the nozzles 22. The conduits 24 may include pipes, hoses, tubes, etc. Each nozzle 22 may be fed with cooling fluid 10 from the fluid supply 20 by a various array of one or more conduits 24. In one nonlimiting example, such as that depicted in FIG. 7, one individual conduit 24 extends directly from the fluid supply 20 and fluidly connects directly to each nozzle 22. Other arrangements can be used, including the nozzles 22 being fluidly connected in parallel to the fluid supply 20, such as that depicted in FIG. 9, where a plurality of conduits 24 fluidly connect the nozzles 22 in a parallel so as to deliver the cooling fluid 10 from the fluid supply 20 to the mold 4. This parallel-type fluid connection between the fluid supply 20 and the nozzles 22 may be used to solidify the molten material 12 in the mold cavity 8 in a uniform fashion, e.g. even cooling over the outside surface 18 of the molten material. Other configurations of conduits 24 can be used, including for example, connecting the nozzles 22 in series.

The sensor 28 may be a pressure sensor arranged at a location on the fluid path defined by the fluid delivery system 14 so as to be able to determine a pressure of the cooling fluid 10 inside fluid path at that location. The pressure of the cooling fluid 10 as measured by the sensor 28 is defined as the delivery pressure of the cooling fluid 10, which delivery pressure may be intentionally varied during solidification of the molten material 12. The location at which the sensor 28 is arranged is not particularly limited. The sensor 28 may be a pressure sensor, and may be arranged at various positions along a fluid path defined by the fluid delivery system 14, so as to measure the delivery pressure of the fluid at one position along the fluid path defined by the fluid delivery system 14. As shown in FIG. 7, the sensor 28 is arranged along a length of the tube 24 so as to measure the delivery pressure at that location along the length of the tube 24. However, this arrangement is not required, and instead the sensor 28 could be arranged at different locations along the length of the tube 24, such as upstream of the valve 30, inside the nozzle 22, or even inside the mold 4 near the tip 26 of the nozzle 22. More than one sensor 28 could also be used to measure multiple delivery pressures at various locations along the fluid path of the fluid delivery system 14, which pressure may be averaged or otherwise used in combination to arrive at a single delivery pressure for the cooling fluid 10.

The valve 30 controls a flow of the cooling fluid 10 through the system 14. The valve 30 is not particularly limited, and may include a fluid valve such as, but not limited to, a butterfly valve, ball valve, gate valve, plug valve, globe valve, needle valve, pinch valve, gate valve, diaphragm valve, bladder valve, servo valve, etc. One or more valves 30 may be included in the system 14. One or more valves 30 may be included on each of the tubes 24, or only one valve 30 may be used irrespective of how many tubes 24/nozzles 22 are included in the system 14.

Figure 9:
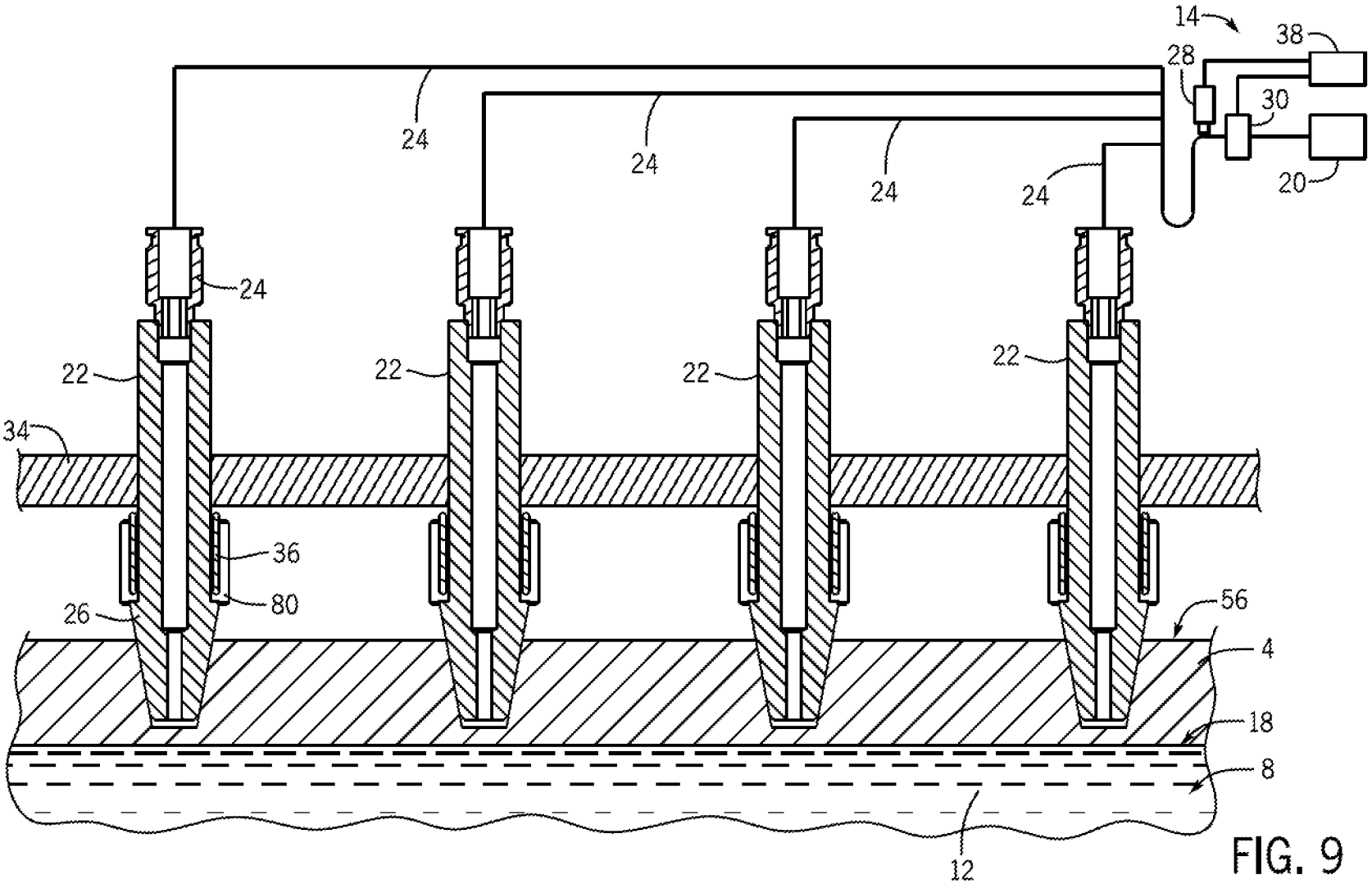
FIG. 9 is a side view of a system used to make a molded object according to the present subject matter.

The frame 34 is used to mount the nozzles 22 relative to the mold 4, and in combination with the resilient members 36, hold the nozzles 22 against the mold 4 and inside the voids in the mold 4. The frame 34 may be mounted rigidly relative to the mold 4. Various rigid mounting methods may be used. The nozzles 22 may each be adjustably mounted on the frame 34 so as to accommodate undulations that may be present in the outer surface 56 of the mold 4. In other aspects, the nozzles 22 may be individually mounted to more than one frame 34 in order to accommodate various mold 4 designs and/or to vary a direction of the nozzle 22 into the mold 4. The mounting of the nozzles 22 on the frame 34 may be adjusted so that the nozzle 22 extends down from the frame 34 a desired distance depending on a distance the outer surface 56 of the mold 4 is from the frame 34. The resilient member 36 is then used to push the nozzle 22 away from the frame 34 and thus urges the nozzle 22 down against the mold 4 and into the void in the mold 4. The resilient members 36 may each be arranged in a housing 80 and may each be individually adjustable so as to provide an individually adjustable force that pushes the nozzle 22 into the void or against the mold 4. As can be seen in FIG. 9, the nozzles 22 are arranged at equal elevations (i.e. their distances from the frame 34 are the same), which elevation is determined by the distance between the outer surface 56 of the mold 4 and the frame 34 at the respective location. However, this is not required, and the elevations of the nozzles 22 from the outer surface 56 of the mold 4 may instead all be different, or some may be different and some the same. The resilient members 36 may be arranged in the housings 80, which may protect the resilient members 36. The tips 26 of the nozzles 22 are arranged in the voids, and the tips 26 are tightly pushed into the voids by the resilient members 36 so as to form a seal between the tips 26 and the voids in the mold 4.

The controller 38 is configured to control the supply of the cooling fluid 10 to the mold 4, and is configured to adjust/vary the delivery pressure at which the cooling fluid 10 is delivered to the mold 4. The controller 38 is in communication with the fluid supply 20 (including the pump and fluid reservoir), the sensor 28, and the valve 30, and may receive data/feedback/information from, and exercise control over the operations of, these components. The controller 38 may operate automatically or semi-automatically on its own, or may be manually operated by a human operator. The controller 38 may include computer circuitry for such automatic operation, which computer circuitry may operate on the basis of programmable software that determines the automatic operation of the controller 38.

In operation, the controller 38 communicates with the sensor 28 to receive data on the measured delivery pressure of the cooling fluid 10; communicates with the valve 30 to control opening and closing of the valve 30, thus allowing the cooling fluid 10 to flow through the valve 30 and to the nozzles 22; and communicates with the fluid supply 20 to control the pump operating to pump the cooling fluid 10 to the nozzles 22, and optionally with the fluid reservoir to ascertain data about the cooling fluid 10 in the fluid reservoir, e.g. how much cooling fluid 10 is in the fluid reservoir. In a further aspect, the fluid reservoir may be pressurized in order to move the cooling fluid 10 to the nozzles 22, which may eliminate need for a pump for this purpose.

Molten Material

The molten material 12 is not particularly limited, and can include a molten metal material, a molten resin material, a molten ceramic material, a molten glass-based material, or other molten material that is capable of solidifying in the mold 4 to form a molded object, or combinations thereof.

Upon being cooled in the mold 4, the molten material 12 solidifies into a solid material that forms a molded object. Permeation of the cooling fluid 10 through the fluid permeable material 6 speeds up the cooling of the molten material 12 such that the molten material 12 solidifies faster than if the cooling fluid 10 were not permeated through the fluid permeable material 6. Upon being introduced into the mold cavity 8, the molten material 12 may initially begin to solidify at its outside surface 18, e.g. at the interface between the molten material 12 and the inside surface of the fluid permeable material 6 defining the mold cavity 8. Such initial solidification of the molten material 12 is due to the hotter molten material 12 contacting the cooler fluid permeable material 6 of the mold 4. Such cooling of at the outside surface 18 may be sped up by permeating the cooling fluid 10 through the fluid permeable material 6, such that the cooling fluid 10 draws heat out of the molten material 12 directly (i.e. by contact with the molten material 18/skin 16) or indirectly (i.e. by contact with the fluid permeable material 6).

The molten material 12 may include additives for enhancing a characteristic of the molten material 12 or of the molded product. The additives may include, for example, non-molten nano-materials, which are capable of forming, upon solidification of the molten material 12, a composite material of the nano-materials dispersed in the solidified material of the molded object.

Method

A method of solidifying the molten material 12 may include providing the molten material 12 in a cavity 8 defined by a mold 4, the mold 4 comprising the fluid permeable material 6; and delivering the fluid 10 to the fluid permeable material 6 such that the fluid 10 permeates through the fluid permeable material 6 and solidifies the molten material 12 to form a solidified outer skin 16. The fluid 10 is delivered to the mold 4 at a delivery pressure that is intentionally varied.

Another method of solidifying the molten material 12 may include providing the mold 4 including the fluid permeable material 6, and providing nozzles 22 arranged in voids in the fluid permeable material 6; arranging the molten material 12 in a cavity 8 defined by the mold 4; and delivering the cooling fluid 10 to the fluid permeable material 6 via the nozzles 22 such that the cooling fluid 10 permeates through the fluid permeable material 6, cools the molten material 12, and solidifies the molten material 12 to form a solidified outer skin 16. The cooling fluid 10 is delivered successively through the nozzles 22 such that the molten material 12 is directionally solidified in a desired direction through the cavity 8. The cooling fluid 10 is delivered to the mold 4 at a delivery pressure that is intentionally varied.

The fluid delivery system 14 delivers the cooling fluid 10 to the fluid permeable material 6 so that the cooling fluid 10 permeates through the fluid permeable material 6 and cools the molten material 12.

The delivery of the cooling fluid 10 may commence before, at the same time, or after the molten material 12 is arranged in the mold cavity 8. In one non-limiting aspect, the cooling fluid 10 is delivered to the mold only after the molten material 12 is arranged in the mold cavity 8. The timing of the delivery of the cooling fluid 10 may be determined according to the thickness of the solidified outer skin 16. In a further aspect, the timing of the delivery of the cooling fluid 10 may be determined according to a temperature of the molten material 12 and/or solidified outer skin 16.

The cooling fluid 10 is transmitted to the mold 4 at a delivery pressure that is intentionally varied. By "intentionally varied" it is meant that the cooling fluid 10 is transmitted to the mold by the fluid delivery system 14 at a pressure that is varied by design and according to a selection made by an operator, rather than at a pressure that is unintentionally varied and rather than being delivered at a constant delivery pressure. This intentional varying of the delivery pressure of the cooling fluid 10 may exclude the time when the delivery of the fluid 10 is started and stopped, which may necessarily include some intrinsic amount of pressure variation.

The delivery pressure may be determined and controlled based on the following Formula I.

$$P_{F'}-P_M<\sigma_M \quad \text{(I)}$$

In Formula I, $P_{F'}$ is the dynamic pressure 66 (FIG. 3) that is exerted by the cooling fluid 10 against the molten material 12 and any solidified outer skin 16, and is also referred to as the "applied pressure." P refers to pressure and $_{F'}$ refers to the cooling fluid 10. $P_{F'}$ may be calculated using the following Formula II.

$$P_{F'}=P_F+P_E-P_{loss} \quad \text{(II)}$$

In Formula II, $P_F$ is the variable delivery pressure measured by the sensor 28 where P refers to pressure and $_F$ refers to the cooling fluid 10. $P_F$ is controlled using the pressure feedback system, which includes the sensor 28 sending pressure readings to the controller 38, and the controller 38 controlling the operation of the valve 30 and fluid supply 20. $P_E$ is the pressure resulting from the expansion of the cooling fluid 10 due to it being heated in the mold 4, and being exerted against the molten material 12 and any solidified outer skin 16, where P refers to pressure and E refers to the expansion of the cooling fluid 10 from heat, for example, the expansion of water into steam/vapor. $P_{loss}$ is the reduction in the delivery pressure resulting from factors including pressure loss from the tubes 24, the permeability of the fluid permeable material 6, the expansion of the vapor, the thickness of the mold through which the cooling fluid 10 has to permeate in order to contact the molten material 12 and any solidified outer skin 16, the sorptivity of the binder used in the fluid permeable material 6 with respect to the cooling fluid 10, the nozzle design (e.g. size of exit openings 48), the quality of the seal formed at the contact area 46, how much vapor is produced, the viscosity of the cooling fluid 10, any restrictions in the fluid path, etc.

In Formula I, $P_M$ is the static pressure 68 (FIG. 3) exerted by the molten material 12 and any solidified outer skin 16 back against the cooling fluid 10, where again P refers to pressure and $_M$ refers to the molten material 12, for example, molten metal. The static pressure may be a function of a head height from a column of molten material 12 used to fill the mold cavity 8, a pressure exerted from a low-pressure casting machine, a height of a column of gas placed atop the column of molten material 12, a weight placed on top of the column of molten material 12, the pressure exerted by a piston used to inject the molten material, the thickness of the skin 16, etc. This $P_M$ factor may also be affected by any coating that may be applied to the inside surface of the fluid permeable material 6, and the strength of such coating may depend on the chemistry of the coating material, a thickness of the coating, the adhesion between the coating and the inside surface of the fluid permeable material 6, etc.

In Formula I, $\sigma_M$ is the yield strength of the molten material 12 at the surface 18, which may be a function of the chemistry of the molten material 12, the temperature of the mold 4, the temperature of the molten material 12, the amount of time the molten material 12 has been in the mold cavity 8, etc.

The method may be performed by controlling only the delivery pressure PF while keeping the other factors constant during molding, such that the following Formula III is satisfied.

$$P_F+P_E-P_{loss}-P_M<\sigma_M \quad \text{(III)}$$

The delivery pressure may be varied as a function of a thickness of the solidified outer skin 16 of the molten material 12. For example, the delivery pressure may be increased as a thickness of the solidified outer skin 16 increases. This control of the delivery pressure may provide for the creation of a defect-free molded object since the dynamic pressure 66 that is exerted by the cooling fluid 10 against the molten material 12 is less than the static pressure 68 exerted back against the dynamic pressure, and thus the cooling fluid 10 does not push into, and thus deform, the surface 18 of the solidified skin 16. In this process, the molten material 12 initially begins to solidify at the outside surface 18 of the molten material 12, and thus may form the solidified outer skin 16 at the surface 18. During this initial solidification, it may be that no cooling fluid 10 is delivered to the mold 4, or it may be that cooling fluid 10 is delivered to the mold before the solidified outer skin 16 begins to develop. The initial solidification occurs because the molten material 12 is contacting the cooler inside surface of the mold 4, and this results in a transfer of heat from the molten material 12 into the mold 4 (See FIG. 8A for example). The solidified outer skin 16 surrounds a remainder of the molten material 12 that is not yet solidified and is arranged inside the outer skin 16. Solidification of the remainder of the molten material 12 continues, and may propagate in a general direction from this outside surface 18 towards an interior of the molten material 12. As this further solidification occurs (See FIG. 8B), the solidified outer skin 16 increases in thickness, and thus the skin 16 becomes stronger as its thickness increases. This further increase in the thickness of the skin 16, along with any pressure provided by the molten material 12 itself, may provide an amount of static pressure 68 to exceed a predetermined threshold value. When the static pressure exceeds this predetermined threshold value, the system 14 may be triggered to begin delivering the cooling fluid 10 to the mold 4 (See FIG. 8C). The delivery pressure at which the cooling fluid 10 is at first delivered to the mold 4 may be relatively low, but may increase as the thickness of the solidified outer skin 16 increases. The thickness of the solidified outer skin 16 may be determined by an actual measurement of the thickness, by an approximation based on the amount of time since the molten material 12 was first arranged in the mold cavity 8, or by other methods.

The strength of the skin 16 may be such that the skin 16 can withstand this increased pressure, and thus the skin 16 may not deform during solidification. If the delivery pressure is increased too much, then the skin 16 may not be strong enough to withstand such pressure, and may be deformed inward by the fluid 10, and thus a surface of the solidified material may be undesirably indented and included depressions or other imperfections that do not conform to the shape of the mold cavity 8. The system 14 may continue to deliver the cooling fluid 10 to the mold until the molten material 12 is solidified (See FIG. 8D). The cooling fluid 10 operates to increase the rate at which the molten material 12 solidifies, by increasing the amount of heat that is drawn out of the molten material 12. The delivery pressure may be varied so that the dynamic pressure 66 exerted by the fluid 10 against the molten material 12 and any solidified outer skin 16 is less than the static pressure 68 exerted by the molten material 12 and any solidified outer skin 16 against the fluid 10.

The cooling fluid 10 may be delivered to the mold 4 only after the solidified outer skin 16 is formed as explained above, or may be delivered to the mold 4 also before the skin 16 is formed, such as if such as if $P_{F'}<P_M$. In this case, the pressure $P_M$ exerted by the molten material 12 is higher than the dynamic pressure $P_{F'}$ so as to prevent the cooling fluid 10 from pressing in on the molten material 12 as it cools.

In one non-limiting aspect, the variable delivery pressure is only an increasing delivery pressure, and the fluid 10 is delivered at the increasing delivery pressure until a delivery of the fluid 10 is stopped. The increasing delivery pressure may be a continuous increasing delivery pressure.

The nozzles 22 may be connected in parallel to the fluid supply 20 as shown in FIG. 9. This may allow the cooling fluid 10 to be delivered essentially equally to all the connected nozzles 22 to provide even cooling at the outer surface 18 of the molten material 12. This process of cooling may cause a directional solidification of the molten material 12 in a direction from the outer surface 18 of the molten material 12 toward a center of the mass of the molten material 12 or simply away from the outer surface 18. Alternatively, the nozzles 22 may be connected in series to the fluid supply 20. Such delivery of the cooling fluid 10 to the series of connected nozzles 22 may result in the molten material 12 directionally solidifying from a nozzle 22 first provided with cooling fluid 10 toward a nozzle 22 last provided with cooling fluid 10.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of solidifying a molten material, comprising:

providing the molten material in a cavity defined by a mold, the mold comprising a fluid permeable material; and delivering a fluid to the fluid permeable material such that the fluid permeates through the fluid permeable material and cools and thus solidifies the molten material to a) form a solidified outer skin at a surface of the molten material, b) increase a thickness of the solidified outer skin, or c) both a) and b):

wherein the fluid is delivered to the mold at a delivery pressure that is intentionally varied; and wherein the delivery pressure is varied as a function of the thickness of the solidified outer skin.

2. The method according to claim 1, wherein the delivery pressure increases as the thickness of the solidified outer skin increases.

3. The method according to claim 1, wherein:

the fluid permeating through the fluid permeable material contacts the molten material or the solidified outer skin in the cavity, and the delivery pressure is varied so that a dynamic pressure exerted by the fluid against the molten material or the solidified outer skin is less than a static pressure exerted by the molten material and the solidified outer skin against the fluid.

4. The method according to claim 1, wherein the fluid is delivered to the mold by a nozzle arranged inside a void in the fluid permeable material.

5. The method according to claim 4, wherein:

the nozzle mates at an interface with the void, and a contact area of the interface is not parallel and is not perpendicular with respect to a longitudinal axis of the nozzle.

6. The method according to claim 4, wherein the nozzle is held inside the void by a biasing member exerting an adjustable force on the nozzle.

7. The method according to claim 4, wherein before the fluid permeates through the fluid permeable material, the fluid exits a distal portion of the nozzle and then the fluid enters a gap between the distal portion and a bottom of the void.

8. The method according to claim 1, wherein the delivery pressure is varied by adjusting only a flow rate of the fluid to the mold.

9. A method of solidifying a molten material, comprising:

providing a mold including a fluid permeable material, and providing nozzles arranged in voids in the fluid permeable material;

arranging the molten material in a cavity defined by the mold; and delivering a cooling fluid to the fluid permeable material via the nozzles such that the cooling fluid permeates through the fluid permeable material, cools the molten material, and solidifies the molten material to a) form a solidified outer skin at a surface of the molten material, b) increase a thickness of the solidified outer skin, or c) both a) and b);

wherein the cooling fluid is delivered successively through the nozzles such that the molten material is solidified in a desired direction through the cavity; and wherein the cooling fluid is delivered to the mold at a delivery pressure that is intentionally varied; and wherein the delivery pressure is varied as a function of the thickness of the solidified outer skin.

10. The method according to claim 9, wherein the nozzles are fluidly connected to one another in parallel.

11. The method according to claim 9, wherein:

the cooling fluid permeating through the fluid permeable material contacts the molten material in the cavity, the delivery pressure increases as the thickness of the solidified outer skin increases; and the delivery pressure is varied so that a dynamic pressure exerted by the cooling fluid against the molten material and the solidified outer skin is less than a static pressure exerted by the molten material and the solidified outer skin against the cooling fluid.

12. The method according to claim 9, wherein:

each nozzle is held in its respective void by a resilient member that is mounted on a frame, and the resilient member exerts an adjustable force to the nozzle.

13. A molding system comprising:

a mold including a fluid permeable material that defines a mold cavity and is permeable to a cooling fluid, the mold being configured to mold a molten material arranged in the mold cavity; and a fluid delivery system in fluid communication with the fluid permeable material, and configured to deliver the cooling fluid to the fluid permeable material;

wherein when the molten material is arranged in the mold cavity, the fluid delivery system includes a controller configured to deliver the cooling fluid to the fluid permeable material at a delivery pressure that is intentionally varied, such that the cooling fluid permeates through the fluid permeable material to cool and solidify the molten material arranged in the mold cavity to a) form a solidified outer skin at a surface of the molten material, b) increase a thickness of the solidified outer skin, or c) both a) and b); and wherein the controller is configured to vary the delivery pressure as a function of the thickness of the solidified outer skin.

14. The molding system according to claim 13, wherein when the molten material is arranged in the mold cavity, the fluid delivery system increases the delivery pressure as the thickness of the solidified outer skin increases.

15. The molding system according to claim 13, further including a fluid supply that when the molten material is arranged in the mold cavity, supplies the cooling fluid for delivery by the fluid delivery system.

16. The molding system according to claim 13, wherein:

the fluid delivery system includes a nozzle in fluid communication with the fluid permeable material;

the fluid permeable material includes sand; and the nozzle is arranged inside a void in the fluid permeable material.

17. The molding system according to claim 16, wherein:

the nozzle includes an exit opening through which the cooling fluid is delivered to the fluid permeable material when the molten material is arranged in the mold cavity;

the exit opening is arranged in a distal portion of the nozzle;

when the nozzle is mounted on the mold, a gap exists between the exit opening and a bottom of the void; and when the molten material is arranged in the mold cavity, the cooling fluid enters the gap before the cooling fluid permeates through the fluid permeable material.

18. The molding system according to claim 17, wherein the nozzle is held in the void by a resilient member that provides an adjustable force that pushes the nozzle into the void.

19. The molding system according to claim 13, wherein:

when the molten material is arranged in the mold cavity, the cooling fluid permeates through the fluid permeable material and contacts the molten material arranged in the mold cavity;

when the molten material is arranged in the mold cavity, the fluid delivery system varies the delivery pressure so that a dynamic pressure exerted by the cooling fluid against the molten material and the solidified outer skin is less than a static pressure exerted by the molten material and the solidified outer skin against the cooling fluid;

the fluid delivery system includes a pressure sensor measuring the delivery pressure when the molten material is arranged in the mold cavity; and the fluid delivery system includes a valve controlling a flow of the cooling fluid in the fluid delivery system when the molten material is arranged in the mold cavity.

* * * * *